United States Patent [19]

Adleman

[11] Patent Number: 4,537,052

[45] Date of Patent: Aug. 27, 1985

[54] FOLLOW BAR WITH CAM TRACKS FOR ROCKER TYPE CONDUIT BENDER

[76] Inventor: Larry G. Adleman, 1307 E. Gate Parkway, Rockford, Ill. 61108

[21] Appl. No.: 630,912

[22] Filed: Jul. 13, 1984

[51] Int. Cl.[3] ..... B21D 7/04

[52] U.S. Cl. ..... 72/154; 72/388

[58] Field of Search ..... 72/149, 154, 155, 157, 72/158, 159, 321, 388, 459

[56] References Cited

U.S. PATENT DOCUMENTS

| | | | |
|---|---|---|---|
| 983,664 | 2/1911 | Wilson | 72/159 X |
| 1,935,604 | 11/1933 | Abramson et al. | 72/154 |
| 2,754,879 | 7/1956 | Gautier | 72/154 |
| 2,754,880 | 7/1956 | Kuehlman et al. | 72/154 |
| 2,812,004 | 11/1957 | Huet | 72/154 |
| 2,955,638 | 10/1960 | Hellwig | 72/158 X |
| 3,555,868 | 1/1971 | Hagemeyer | 72/154 |
| 3,987,656 | 10/1976 | Evenson | 72/154 |

FOREIGN PATENT DOCUMENTS

| | | | |
|---|---|---|---|
| 953397 | 11/1956 | Fed. Rep. of Germany | 72/154 |

*Primary Examiner*—E. Michael Combs

[57] ABSTRACT

The follow bar of a rocker type conduit bender includes a pair of cam tracks with a series of angular ramp surfaces along their length. The inclination of the ramp surfaces relative to the working surface of the bender shoe is varied inversely with changes in length of the bender lever arm to provide more uniform bending forces on the conduit.

5 Claims, 12 Drawing Figures

52
60
78
76
102
100
112
106
72
42
32
64
10
80
82
50
62
58
40
48
70
30
54
104
B
α
D
R
DN
α1
B1

FOLLOW BAR WITH CAM TRACKS FOR ROCKER TYPE CONDUIT BENDER

FIELD OF THE INVENTION

The invention relates to conduit and tube benders especially of the rocker type and, in particular, to an improved follow bar construction for such rocker type benders to create a more uniform bending force on the conduit.

BACKGROUND OF THE INVENTION

As shown in FIG. 1, rocker type conduit benders operate by hydraulic ram force F transmitted through pivot axis A on the shoe 1. This action causes the shoe to revolve around or near axis B which is the centerline location of the shoe radius R. The conduit C is bent between shoe 1 and follow bar 2 which slides on roller 3 as the shoe revolves. A saddle 4 fixed on the shoe grips the conduit for bending.

As is apparent, the lever arm L between axes or points A and B varies in magnitude as the hydraulic ram 6 moves connector pin 7 (forming pivot axis A) along slots 8 in the connector bars 9 in the direction of the roller 3. As a result of the geometrical variation between axes A and B and hence in the length of the lever arm as the shoe rotates, a large variation in bending force exerted on the conduit C exists and in the past has produced non-uniform bends in larger conduit sizes.

SUMMARY OF THE INVENTION

The invention contemplates a rocker type conduit bender having a cam means operative with the bending shoe and follow bar to create negative or positive changes in bending force as needed to accommodate changes in lever arm length to provide more uniform bending forces on the conduit during bending.

In a typical working embodiment of the invention, the follow bar includes a pair of cam tracks with a series of ramp surfaces whose inclination relative to the working surface of the bender shoe is varied in inverse relation to changes in lever arm length of the bender to substantially improve uniformity of bending forces exerted on the conduit. A 90° bend can be made in rigid, EMT and IMC conduit in sizes up to 4 inches in diameter in one-shot (one hydraulic ram stroke) instead of two shots without substantial wrinkling of the conduit as a result of the more uniform bending forces applied.

DESCRIPTION OF PREFERRED EMBODIMENTS

Figure 1:
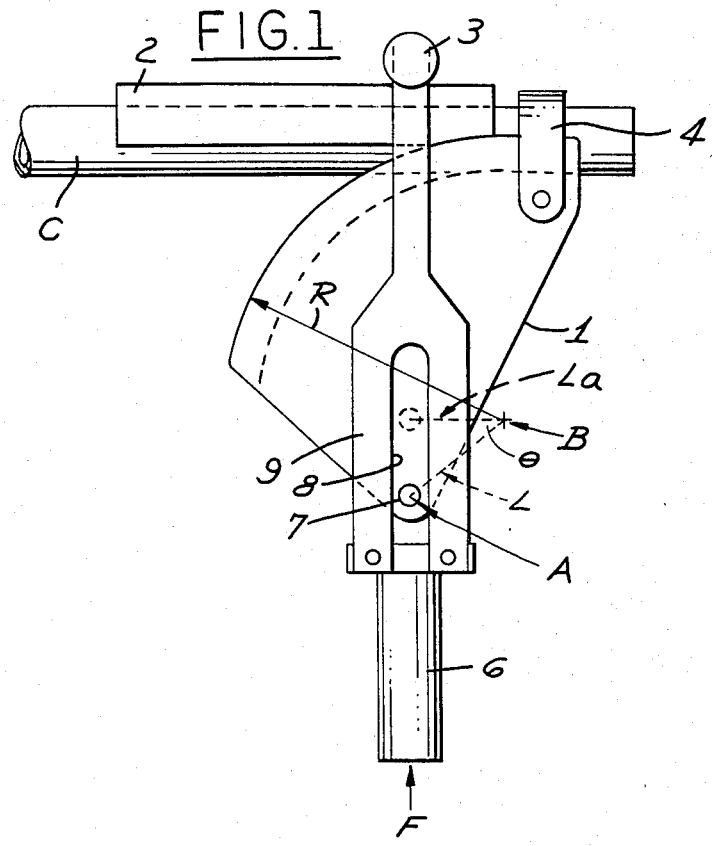
FIG. 1 is a schematic illustration of a rocker type conduit bender showing certain geometrical features.
Figure 2:
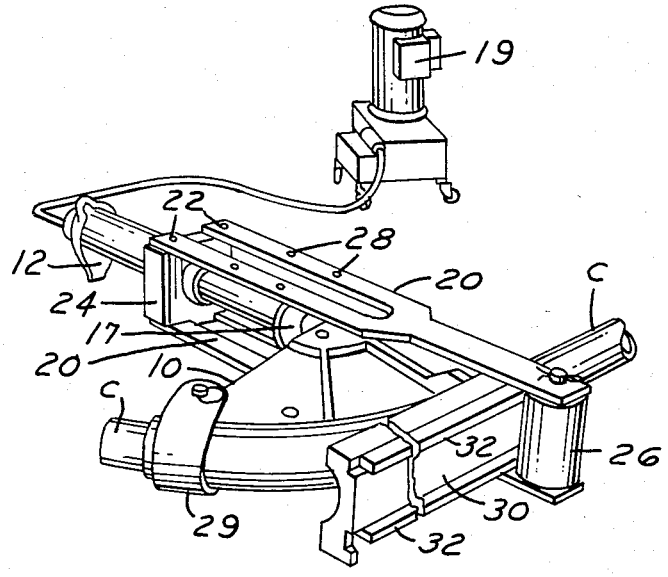
FIG. 2 is a more detailed perspective view of a rocker type conduit bender.

FIG. 2 illustrates a rocker type conduit bender for bending rigid, EMT and IMC steel or aluminum conduit commonly used in building construction to carry electrical power lines throughout a building. The bender includes a bending shoe 10 pivotally connected to hydraulic ram 12 at axis A offset from the rotational axis B of the shoe 10 by the lever arm distance, the pivotal connection provided by means of a pin (not shown) corresponding to pin 7 in FIG. 1 and yoke connector 17 as is well known. The hydraulic ram is powered by a hydraulic power pump 19. Connector bars 20 in spaced relation on opposite sides of the shoe 10 are connected by pins 22 to the hydraulic cylinder block 24 at one end and to a support roller 26 at the other end. Connectors 20 include multiple pairs of apertures 28 adapted to receive pins 22 and are provided so that the different size shoe and follow bar combinations can be used. That is, the connectors are adjustable relative to the hydraulic cylinder block. The shoe 10 has a so-called saddle 29 connected thereto extending partially around the conduit circumference to grip and bend the conduit with shoe rotation.

The elongated follow bar 30 includes a pair of cam tracks or bars 32 attached thereto as explained herebelow for sliding engagement with the roller 26 as the conduit C is bent. As is known, the follow bar 30 moves over roller 26 with rotation of shoe 10 during bending. For shoe rotation clockwise about axis B in FIG. 2, follow bar 30 would move to the left a linear distance in FIG. 2 substantially equal to the circumferential movement of shoe 10 about radius R.

Figures 7, 9, 10:
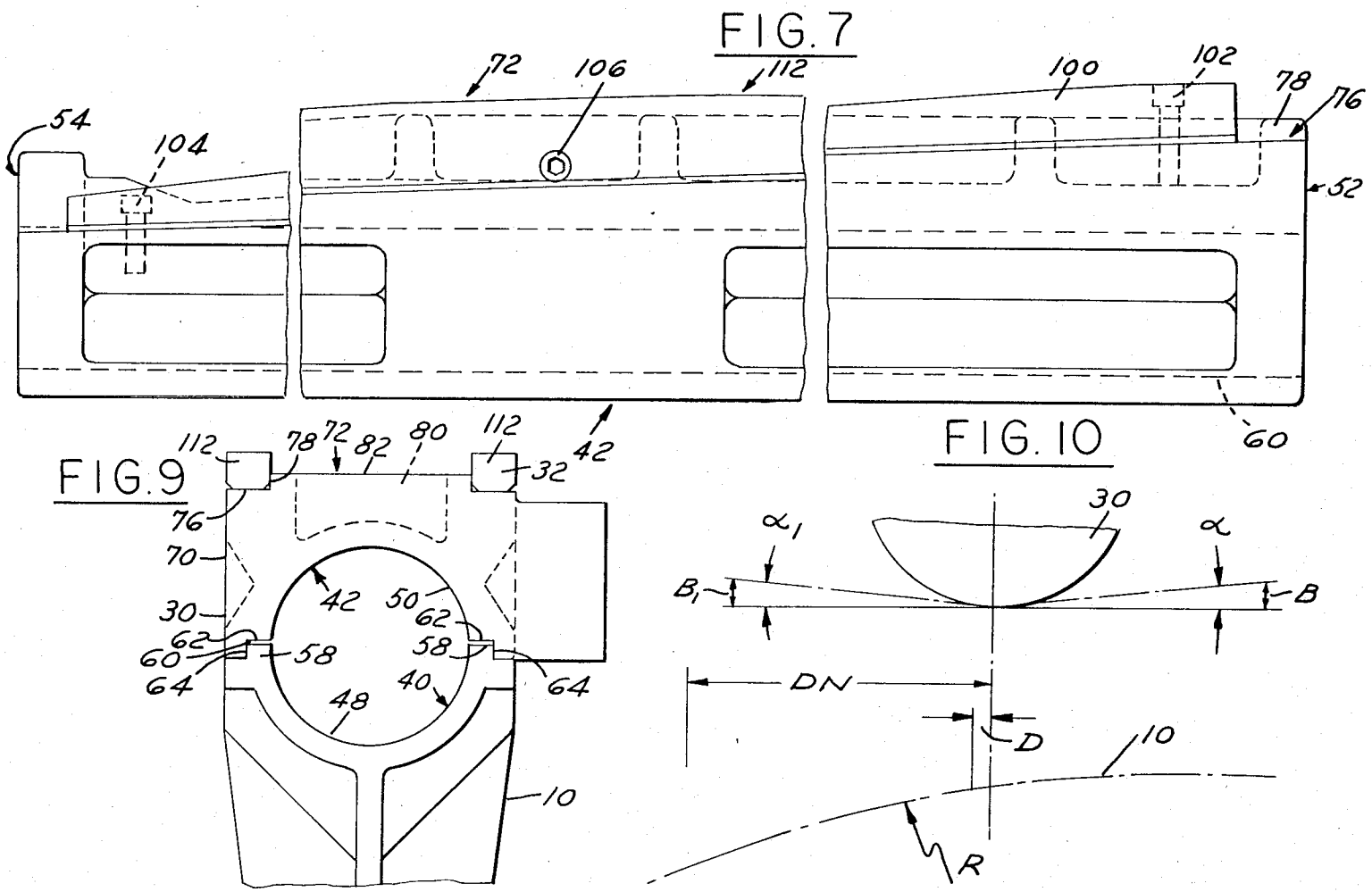
FIG. 7 is a side elevation of the follow bar.
FIG. 9 is an end view of the follow bar and shoe together with the conduit therebetween.
FIG. 10 is a schematic illustration enlarged showing geometrical parameters between the shoe and follow bar.

As shown more clearly in FIG. 9, the shoe 10 and follow bar 30 include respective facing working surfaces 40,42 having semi-circular cross-section channels 48,50 which together form or define a generally circular cross-section channel adapted to receive conduit C during bending. Channel 40 of shoe 10 extends circumferentially around the shoe periphery which is in the form of a portion of a circular arc defined by radius R. Channel 42 of follow bar 30 extends along the longitudinal axis thereof from the leading end 52 to the trailing end 54 thereof, the leading end being that end which first mates with the shoe 10. The working surface 40 of the shoe 10 includes circumferentially extending shoulders 58 adapted to mate in spaced relation in longitudinally extending side grooves 60 of the follow bar as shown. Each groove 60 is formed of a longitudinal shoulder 62 and a side wall 64 transverse thereto as shown in FIG. 9.

The components of the follow bar 30 are shown in more detail in FIG. 3–6. The follow bar includes an elongated cast body 70 having leading end 52 and trailing end 54 with the first working surface 40 described above extending longitudinally therebetween. The follow bar body 70 also includes a second working surface 72 which faces the support roller 26 when the follow bar is in operative position to the shoe 10. On the second working surface 72 are longitudinally extending grooves 74 formed by longitudinal shoulders 76 and transverse side walls 78 intersecting therewith. Between side walls 78 are recesses 80 and transverse webs 82 to reduce weight of the body 70 and yet retain strength.

Each shoulder 76 includes a tapped hole 84 adjacent the leading end and a tapped hole 85 adjacent the trailing end. Side walls 78 include an intermediate tapped hole 86 extending transverse to the longitudinal axis of the follow bar and to the tapped holes 84,85. Transversely extending stops 88 and 90 are provided at the leading end and trailing end, respectively, to limit movement of the follow bar during bending and release of the bent conduit.

Figure 3:
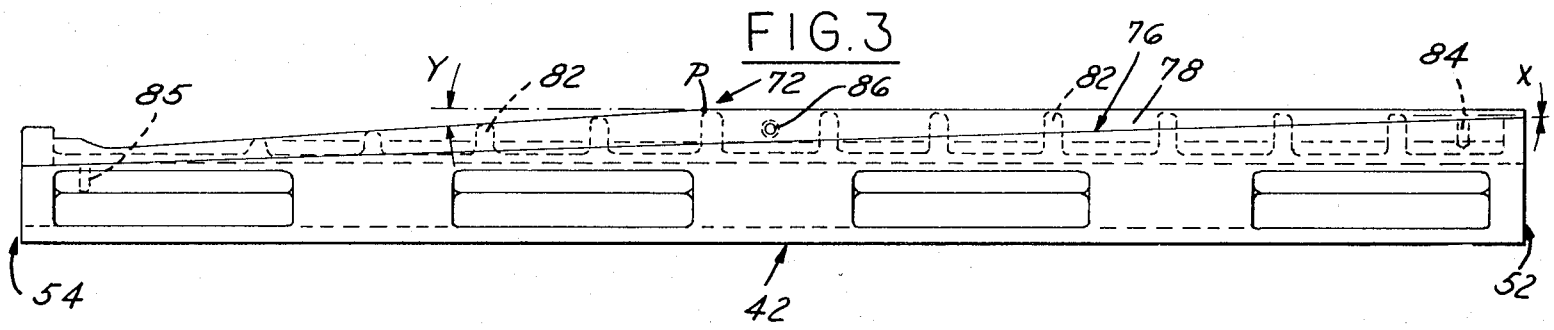
FIG. 3 is a side elevation of the follow bar body on which the cam tracks are mounted.
Figure 4:
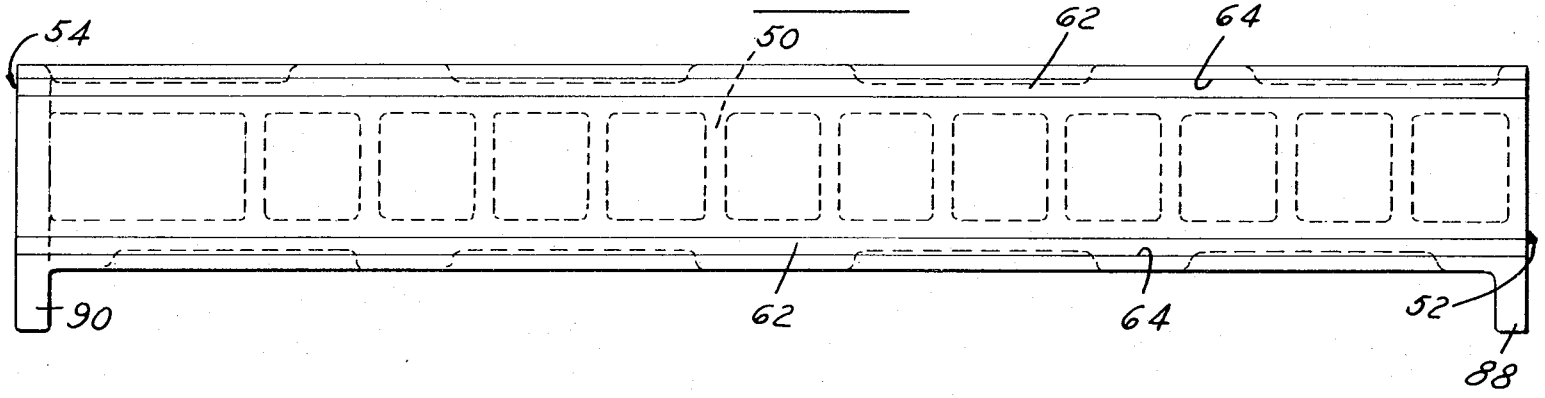
FIG. 4 is a top elevation of the follow bar body.

As shown most clearly in FIG. 3, longitudinal shoulders 76 slope longitudinally at a slight angle X, e.g. 2°, toward the plane of the first working surface 40 from the leading end to the trailing end of the body 70. The top of side walls 78 extending from the leading end are initially substantially parallel with the first working surface 40 and then the top slopes longitudinally at a slight angle Y, e.g. 4°, toward the first working surface 40 from juncture point P toward the trailing end of the follow bar body 70.

Figure 8:
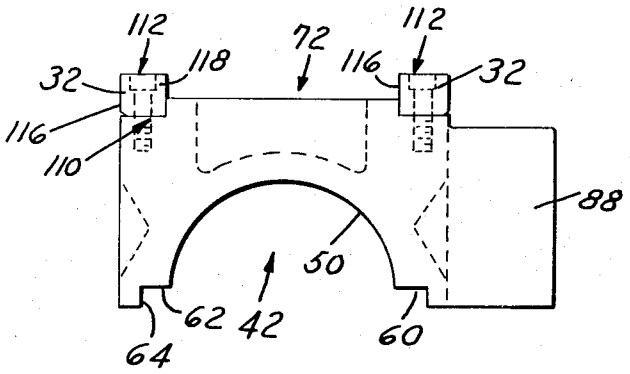
FIG. 8 is an end elevation of the follow bar.
Figure 5:
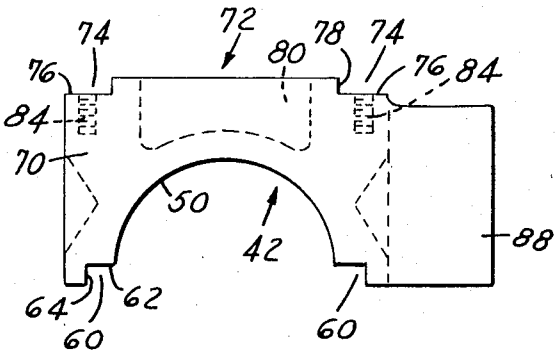
FIG. 5 is an end elevation of the follow bar body.

FIGS. 7 and 8 show the two cam tracks or bars 32 attached in the grooves 74 on the follow bar cast body 70 by machine screws 102 threadably received in tapped holes 84, machine screws 104 threadably received in tapped holes 85 and machine screws 106 threadably received in tapped holes 86. Each cam track is identical and is in the form of an elongated bar having a supported surface 110 adapted to rest on slightly tapered or angled (2°) shoulder 76 as shown and having a profiled or cam surface 112 on the opposite of the bar facing the roller 26 when the follow bar 30 is in operative position shown in FIG. 2.

FIG. 8 is a side elevation of the cam track 32 for use with a shoe for making a 45° bend illustrating that the supported surface 110 is machined flat and perpendicular to the substantially parallel sides 116 and substantially parallel ends 118 of the body 120 of the cam track. Importantly, the cam surface 112 includes a series of angular or inclined ramps $R_1$–$R_{60}$ defined between locations numbered 1 to 61 on FIG. 6. Locations 1 to 61 in turn are defined by coordinates A and B which are listed below where A is the axial or longitudinal distance of each location (LOC) 1 to 61 from the leading end 122 of the cam track and where B is the height of each location relative to the supported surface 110.

| LOC | A | B | LOC | A | B | LOC | A | B |
|---|---|---|---|---|---|---|---|---|
| 1 | 3.380 | 1.645 | 22 | 11.077 | 1.650 | 43 | 18.774 | 1.540 |
| 2 | 3.746 | 1.649 | 23 | 11.443 | 1.647 | 44 | 19.140 | 1.532 |
| 3 | 4.113 | 1.653 | 24 | 11.810 | 1.644 | 45 | 19.507 | 1.524 |
| 4 | 4.479 | 1.656 | 25 | 12.176 | 1.640 | 46 | 19.873 | 1.515 |
| 5 | 4.846 | 1.659 | 26 | 12.543 | 1.636 | 47 | 20.240 | 1.506 |
| 6 | 5.212 | 1.661 | 27 | 12.910 | 1.632 | 48 | 20.606 | 1.497 |
| 7 | 5.579 | 1.663 | 28 | 13.276 | 1.627 | 49 | 20.973 | 1.486 |
| 8 | 5.945 | 1.665 | 29 | 13.643 | 1.622 | 50 | 21.339 | 1.475 |
| 9 | 6.312 | 1.666 | 30 | 14.009 | 1.617 | 51 | 21.706 | 1.464 |
| 10 | 6.678 | 1.667 | 31 | 14.375 | 1.612 | 52 | 22.073 | 1.452 |
| 11 | 7.045 | 1.668 | 32 | 14.742 | 1.607 | 53 | 22.439 | 1.440 |
| 12 | 7.411 | 1.669 | 33 | 15.108 | 1.602 | 54 | 22.805 | 1.426 |
| 13 | 7.778 | 1.668 | 34 | 15.475 | 1.597 | 55 | 23.172 | 1.412 |
| 14 | 8.145 | 1.667 | 35 | 15.841 | 1.592 | 56 | 23.538 | 1.398 |
| 15 | 8.511 | 1.666 | 36 | 16.208 | 1.586 | 57 | 23.905 | 1.382 |
| 16 | 8.878 | 1.665 | 37 | 16.574 | 1.580 | 58 | 24.271 | 1.366 |
| 17 | 9.244 | 1.663 | 38 | 16.941 | 1.574 | 59 | 24.638 | 1.348 |
| 18 | 9.611 | 1.661 | 39 | 17.308 | 1.568 | 60 | 25.004 | 1.330 |
| 19 | 9.977 | 1.659 | 40 | 17.674 | 1.561 | 61 | 25.371 | 1.312 |
| 20 | 10.344 | 1.656 | 41 | 18.041 | 1.554 | | | |
| 21 | 10.710 | 1.653 | 42 | 18.407 | 1.547 | | | |

Figure 6:
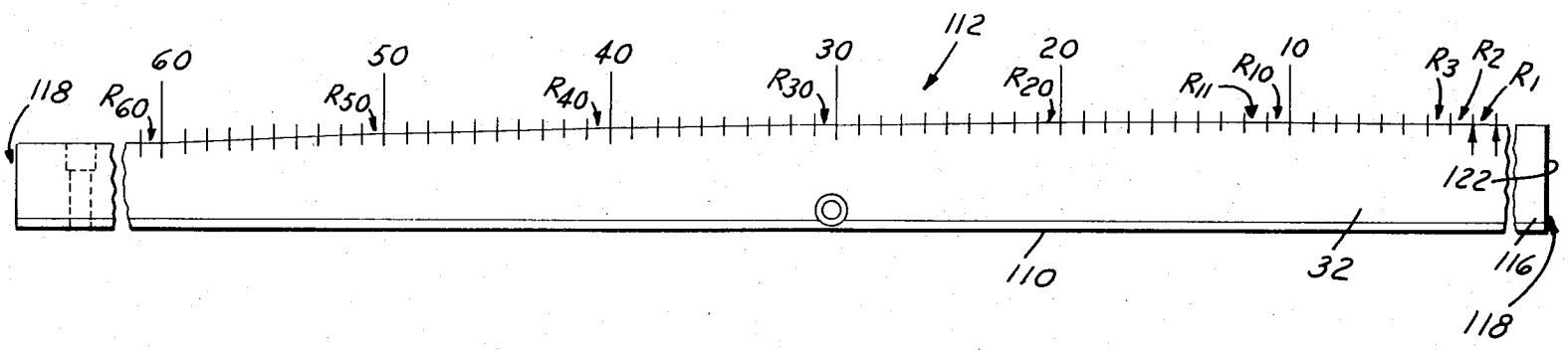
FIG. 6 is a side elevation of one of the two identical cam tracks.

Relative to FIG. 6 and the above A-B coordinates, it can be seen that the series of ramps $R_1$–$R_{60}$ increase in height relative to the supported surface 110 as they approach ramp $R_{12}$. After ramp $R_{12}$, the ramps $R_{13}$ to $R_{60}$ decrease in height toward the trailing end of the cam track.

The specific coordinates A and B for locations 1–61 are varied in accordance with changes in lever arm length L of the bender to provide incremental positive or negative changes in bending force to accommodate the lever arm length changes and thereby linearize the bending force exerted on conduit C. Specific coordinates A and B are determined taking into consideration the longitudinal slope or taper of shoulders 76 on which the supported surface 110 ultimately rests. Different coordinates would be involved in the event longitudinal shoulders 76 have a different slope or are parallel with the supported surface.

Specific coordinates A and B are determined mathematically in the following manner. With reference to FIG. 1 which illustrates the geometrical relationship involved in a rocker type bender, the torque lever arm length L of the bender (between connector pin 7 and axis B) at the beginning of the stroke is shown. The torque lever arm length La after angular rotation of the lever arm by theta, $\theta$, degrees about or near axis B is also shown and corresponds to a second stroke position of the pin 7. It is apparent that La is equal to $\cos\theta \times L$. Of course, the torque at the shoe radius R from an initial F is described by T (torque)$=(F\times L)/R$ and the torque at the shoe radius R from the same force at the second stroke position is described by $T_a=(F\times La)/R$. A force vector analysis at the working surfaces 40,42 of the shoe 10 and follow bar 30 in FIG. 10 leads to the following equation to decrease bending force:

$$[(F\times L)/R-(F\times La)/R]/F=\tan\alpha \qquad \text{(Ia)}$$

and to increase bending force:

$$[(F\times L)/R-(F\times La)/R]/F=\tan\alpha_1 \qquad \text{(Ib)}$$

where $\tan\alpha$ and $\tan\alpha_1$ are relative to a tangent line to either working surface 40 of shoe 10 or working surface 46 of follow bar 30. $\tan\alpha_1$ is selected as a positive parameter resulting in a positive incline on ramp surfaces $R_1$–$R_{60}$ while $\tan\alpha$ is selected as a negative parameter resulting in a negative incline on ramp surfaces $R_1$–$R_{60}$ as needed to improve linearity of the bending forces in view of changes in lever arm length. Selecting constant operating values for bending torque and hydraulic ram force for the bender allows the angle and sign (+or −) of incline of the ramp surfaces to be determined at a given point on the follow bar working surface from these equations.

Coordinates A and B are then determinable from the following geometrical relation existing at the working surfaces 40,42 as is apparent from FIG. 10.

$$B=\tan\alpha\times DN \text{ to decrease bending force} \qquad \text{(IIa)}$$

$$B=\tan\alpha_1\times DN \text{ to increase bending force} \qquad \text{(IIb)}$$

For example, during bending, the shoe 10 rotates about axis or point B and for each 1° of shoe rotation, the shoe circumference and follow bar will move a distance D equal to $2R\times\pi/360°$. For lever rotation through angle $\theta$ shown in FIG. 1, the shoe circumference and follow bar will move a distance DN equal to D times the number of $\theta$ degrees. Thus, DN can be correlated to coordinate A, the length or distance along the longitudinal axis of the follow bar from the leading end. By knowing values for tan $\alpha$ and tan $\alpha_1$ from equations Ia and Ib above and selecting suitable incremental values for DN, coordinates A and B can be determined for each location 1 to 61. That is, equations Ia, Ib, IIa, IIb can be used to output the A-B coordinates that would substantially increase uniformity of bending force on the conduit C by inputting selected values for $\theta$, F and L and La.

Figure 11:
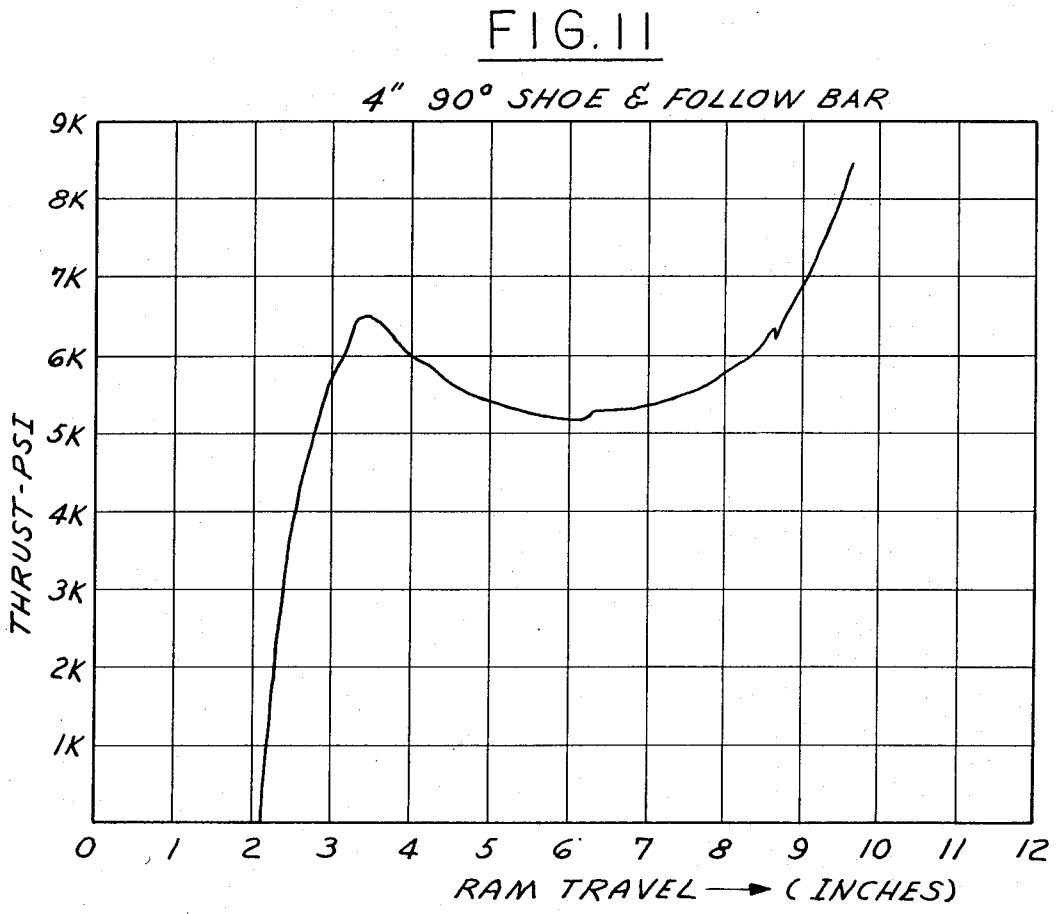
FIG. 11 is a plot of bending force versus follow bar movement for a prior art rocker type bender.

FIG. 11 is a graphic plot of bending force versus movement of the connector pin (or ram travel) for a prior rocker type conduit bender having a 90° bending shoe and tracks attached to the follow bar but not having cam surfaces in accordance with the invention. Instead, the second working surface of the tracks was parallel to the first working surface of the follow bar, i.e., the surface facing the bender shoe. The wide variation in bending force is evident from the plot.

Figure 12:
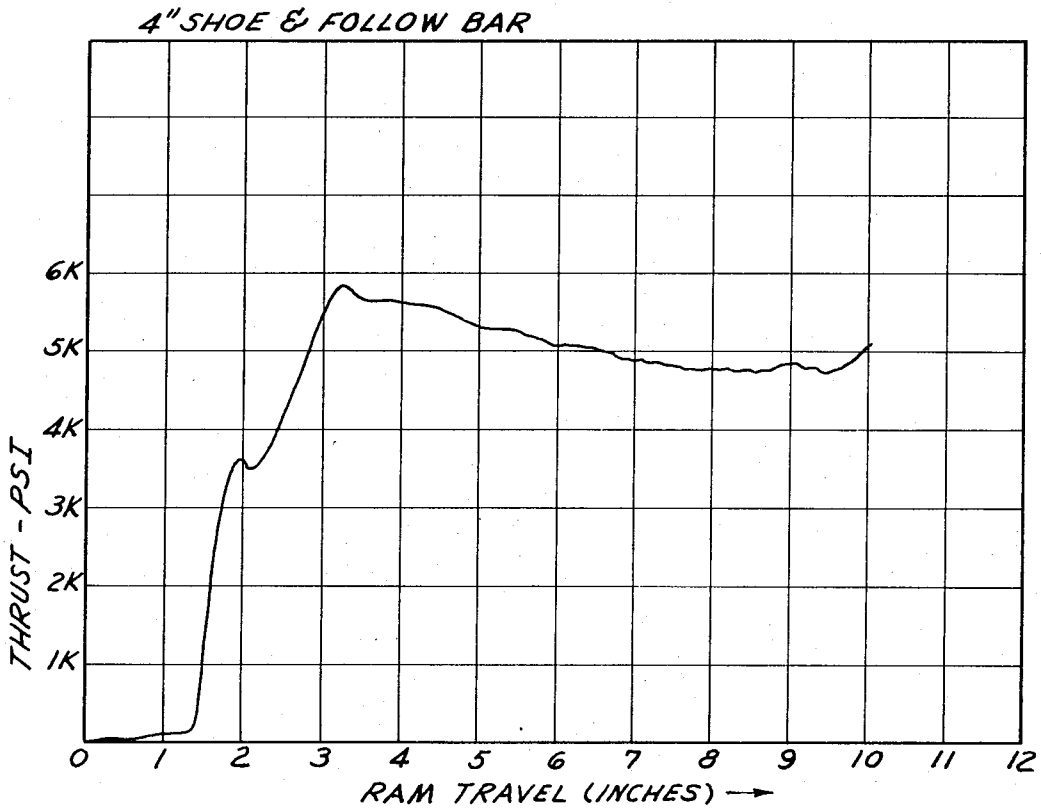
FIG. 12 is a similar plot for a rocker type bender using the inventive follow bar with cam tracks.

FIG. 12 is a similar plot for a rocker type bender with cam tracks 32 described hereinabove in accordance with the invention. The vast improvement in uniformity in bending force is evident.

The improved uniformity or linearity in bending force on the conduit allows a 90° bend to be made in one shot (one stroke of hydraulic ram 12) whereas in the past two shots or strokes were required to make the same bend to avoid imposing ultra high forces on the bender from wide variations in bending force.

For the sake of illustration, the initial force of the hydraulic ram 12 at the beginning of the stroke (i.e., with the lever arm length L) was taken as the reference from which the calculation of coordinates A,B and thus the inclines and signs of the series of ramps $R_1$ to $R_{60}$ were determined. Those skilled in the art will appreciate that other references for lever arm length may be used. For example, lever arm length La might be used and would determine and result in a wholly different set of A,B coordinates and different series of ramp surfaces on cam tracks 32 to increase uniformity or linearity of the bending forces on the conduit. The variation of the incline and sign of the ramp surfaces would be correlated with the changes in lever arm length during bending to substantially improve linearity of the bending forces. Likewise it is apparent that these principles may be applied to any radius (size) of shoe and any specific conduit size.

While certain specific and preferred embodiments of the invention have been described in detail hereinabove, those skilled in the art will recognize that various modifications and changes can be made therein with the scope of the appended claims. For example, the follow bar may be provided with a suitable cam surface to effect the desired changes in bending force with changes in lever arm length. The appended claims are intended to include equivalents of such embodiments.

I claim:

1. In a rocker type conduit or tube bender having a shoe wherein a bending force is transmitted through an axis thereon offset from the axis of shoe rotation by a lever arm distance which varies during bending and having a follow bar movable with rotation of the shoe with the conduit therebetween, the improvement comprising cam means provided on the follow bar and configured to effect changes in bending force on the conduit in relation to changes in lever arm distance to enhance uniformity of bending force on the conduit during rotation of the shoe and consequent bending of the conduit or tube.

2. In a rocker type conduit or tube bender having a shoe wherein a bending force is transmitted through an axis thereon offset from the axis of shoe rotation by a lever arm distance which varies during bending and having a follow bar movable with rotation of the shoe with the conduit therebetween, the improvement comprising cam means provided on the follow bar and configured to effect changes in bending force on the conduit in inverse relation to changes in lever arm distance to enhance uniformity of bending forces on the conduit during rotation of the shoe and consequent bending of the conduit or tube.

3. The bender of claim 2 wherein the cam means comprises a series of angular ramp surfaces on the follow bar having an inclination selected to effect said changes in bending force on the conduit in inverse relation to changes in lever arm distance during bending.

4. The bender of claim 3 wherein the follow bar includes a body and at least one cam track attached to the body, said cam track having said series of ramp surfaces to effect said changes in bending force on the conduit in inverse relation to changes in lever arm distance during bending.

5. The bender of claim 3 wherein the series of ramp surfaces includes a first series of ramp surfaces extending from a leading end of the follow bar toward a trailing end and gradually increasing in height and further includes a second series of ramp surfaces extending from the first series toward the trailing end and gradually decreasing in height.

* * * * *